US005327586A

United States Patent [19]

Evans et al.

[11] Patent Number: 5,327,586

[45] Date of Patent: Jul. 12, 1994

[54] DANCE SKIRT

[75] Inventors: Gretchen S. Evans; Heather M. Reddy, both of Denver, Colo.

[73] Assignee: Gretchen Storer Evans, Denver, Colo.

[21] Appl. No.: 12,330

[22] Filed: Feb. 2, 1993

Related U.S. Application Data

[63] Continuation-in-part of Ser. No. 523,430, May 15, 1990, abandoned.

[51] Int. Cl.[5] ..... A41D 1/14

[52] U.S. Cl. ..... 2/211; 2/47; 2/48; 2/74; 2/75; 2/DIG. 4; D2/861

[58] Field of Search ..... 2/211, 212, 213, 48, 2/47, 74, 75, DIG. 7, DIG. 4, 243 R, 243 B, 243.1; D2/79, 223, 226, 227, 34, 36, 38, 40, 39, 41

[56] References Cited

U.S. PATENT DOCUMENTS

| | | | |
|---|---|---|---|
| D. 138,128 | 6/1944 | Nachman et al. | 2/226 |
| 988,350 | 4/1911 | Kelsey | 2/211 |
| 1,104,185 | 7/1914 | George | 2/211 |
| 1,695,590 | 12/1928 | Jensen | 2/79 |
| 2,570,848 | 10/1951 | Ozenberger | 2/48 |
| 2,914,771 | 12/1959 | Slavin | 2/48 |

FOREIGN PATENT DOCUMENTS

| | | | |
|---|---|---|---|
| 1131815 | 2/1957 | France | 2/211 |
| 465139 | 5/1937 | United Kingdom | 2/75 |

OTHER PUBLICATIONS

Dennison's Party Magazine, vol. II. Oct.-Nov. #5, 1928, p. 18.

"How to Make Crepe Paper Costumes"-Dennis Mffr. Co. 1925, pp. 12-13.

Butterick Pattern Catalog, Mar. 1980. Pattern No. 5896.

*Primary Examiner*—Clifford D. Crowder
*Assistant Examiner*—Gloria Hale
*Attorney, Agent, or Firm*—John E. Reilly

[57] ABSTRACT

A dance skirt is made up of overlapping, downwardly divergent panels, each panel individually connected at its upper edge to a common waistband but otherwise unconnected to one another so as to extend freely away from the waistband, the waistband having free ends releasably connectable to one another including tie members at the free ends, one of which is passed through an opening in a free end and tied to the other tie member so as to lay flat against the waistband.

17 Claims, 1 Drawing Sheet

DANCE SKIRT

CROSS-REFERENCE TO RELATED APPLICATIONS

This is a continuation-in-part of Ser. No. 523,430, entitled DANCE SKIRT, filed May 15, 1990, now abandoned.

This invention relates to wearing apparel and more particularly relates to a novel and improved dance skirt.

BACKGROUND AND FIELD OF INVENTION

Skirts are typically designed as articles of wearing apparel with a single panel or length of material which completely encircles the waist and hip region of the wearer. In certain cases, the skirt has been split or separated and wrapped around or tied very much in the manner of an apron. The same is true of dancing skirts which are customarily shorter than those intended for every day wear.

It is desirable to provide a dance skirt which will fully encircle the waist and hip region when the dancer is not in motion and is capable of separating or expanding in a unique manner when the dancer is in motion, such as, for a ballet dancer in executing various maneuvers. In addition, it is desirable that the skirt not interfere with the dancer's freedom of movement; yet is simple to fabricate, adjustable in size and is conformable for use by children and adults.

SUMMARY OF INVENTION

It is therefore an object of the present invention to provide novel and improved wearing apparel in the form of a skirt which will enhance the movements of a dancer and still afford complete freedom of movement when the dancer is in motion.

Another object of the present invention is to provide for a novel and improved dance skirt made up of a unique combination of flexible panels united to a common waistband and further wherein the waistband has tie members capable of being adjustably secured together in a unique manner.

In accordance with the present invention, a dance skirt has been devised which comprises a waistband including means for adjusting the size of the waistband, front, side and back panels extending downwardly from the waistband, each panel independently connected to the waistband but otherwise unconnected to one another, adjacent of the panels disposed in overlapping relation to one another, and the panels having downwardly divergent side edges with the side edges of each panel extending into a lower common edge. Preferably, the adjusting means includes a pair of flexible tie members at free ends of the waistband with one of the tie members insertable through an opening in the outermost free end so that it can be tied to the other tie member and lay flat against the waistband. Moreover, each of the panels is preferably of generally trapezoidal-shaped configuration, the rear panel being longer than the front panel and opposite side panels each being of a length at its forward edge substantially corresponding to the length of the front panel and of a length at its rearward edge substantially corresponding to the length of the back panel.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
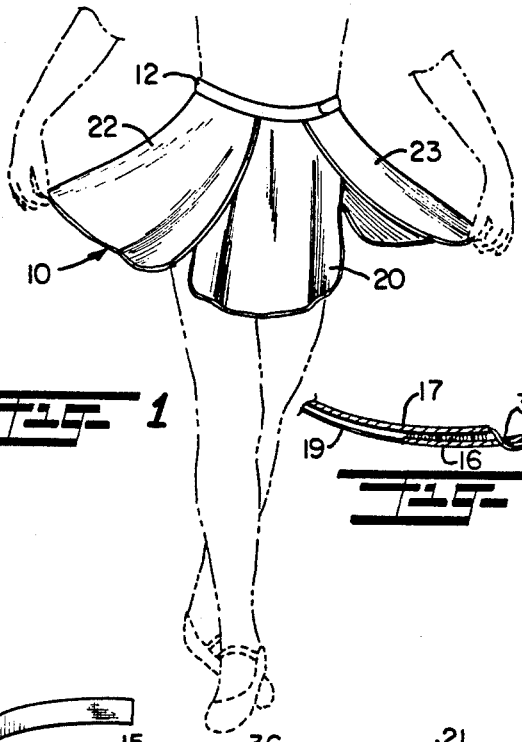
FIG. 1 is a perspective view of a preferred form of dance skirt in accordance with the present invention.

Referring in detail to the drawings, a preferred form of dance skirt 10 is illustrated in FIGS. 1 to 6. For the purpose of illustration and not limitation, the skirt 10 is shown in FIG. 1 when worn by a ballet dancer. As will become more apparent, the skirt 10 is further adaptable for use in other applications but is specifically designed in the preferred form for use by professional dancers, such as, modern and ballet dancers. To this end, the skirt 10 is broadly comprised of a waistband 12 including fasteners 14 and 15 at free ends 16 and 17, and ribbon-like ties 18 and 19 are provided at the free ends 16 and 17, respectively. Front and back panels 20 and 21 as well as opposite side panels 22 and 23 extend downwardly from connected relation to the waistband 12.

Figure 4:
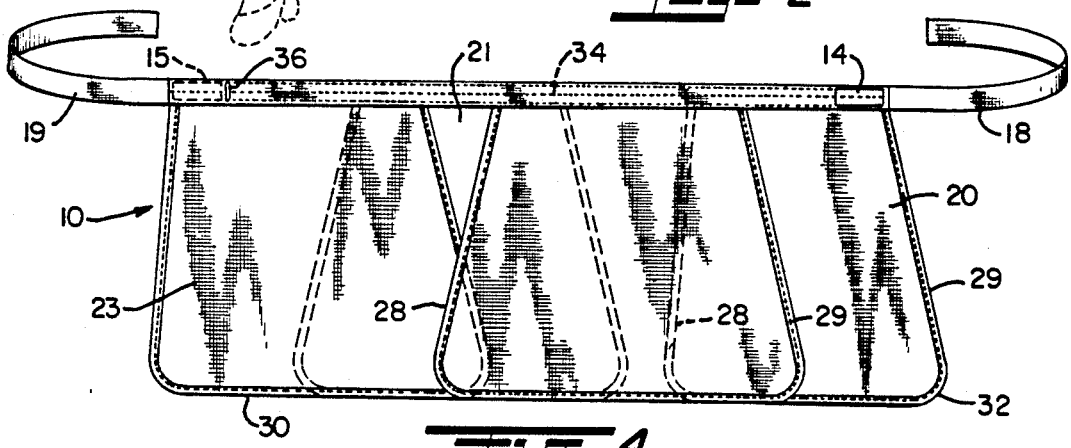
FIG. 4 is a front view of the preferred form of dance skirt when flattened and not in use.
Figure 5:
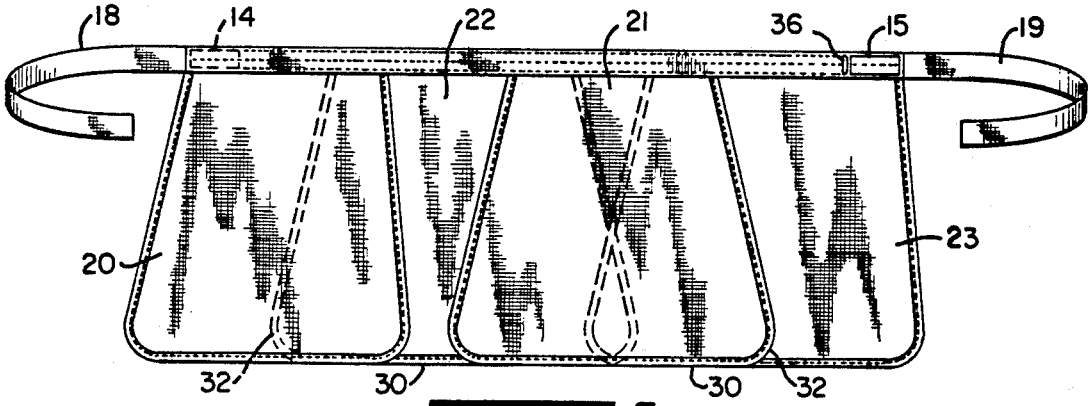
FIG. 5 is a rear view of the preferred form of dance skirt when in the flattened position.

When the skirt 10 is in a flattened condition, as shown in FIGS. 4 and 5, each panel 20 to 23 is of generally trapezoidal configuration having an upper edge 26, downwardly divergent, opposite side edges 28, 29 and a lower edge 30. The intersecting corners between edges 28, 29 and lower edge 30 are curved as at 32. Preferably, each panel 20 to 23 is composed of a fabric or fabric-like material which is both lightweight and flexible.

Considering further the proportioning and relationship between the panels 20 to 23 in the preferred form, the back panel 21 is both wider and longer than the front panel 20, and the side panels 22 and 23 are of corresponding width to one another while being of a greater width than the front panel 20 and of a lesser width than the back panel 21. In addition, by virtue of the slight difference in length between the front panel 20 and back panel 21, the forwardmost side edges 28 of the panels 22 and 23 each corresponds in length to that of the front panel 20 and the rearwardmost edges 29 of the panels 22 and 23 correspond in length to that of the back panel 21. The slight increase in length of the back panel not only compensates for the increase in size of the dancer through the buttocks region but the shorter front panel 20 has been found to lend a much-desired flat look to the hip sockets of the dancer.

Each of the panels 20 to 23 is independently connected along its upper edge 26 to the waistband 12 and such that adjacent panels are connected in overlapping relation to one another, the extent of overlap increasing downwardly toward the lower portion of the panels. The degree or extent of overlap may vary with the size of the skirt but generally is on the order of 15% to 20% between adjacent edges of the panels in relation to the width of the panels 20 to 23. Further, it is desirable that the forwardmost edges 28 of the panels 22 and 23 overlap the front panel 20 and that the back panel 21 has its opposite divergent edges 28 overlapping the rearward edges 29 of the side panels 22 and 23. The overlapping relationship as described is designed to assure that the legs remain covered when the dancer is not in motion but to allow maximum freedom of movement when in motion. If the overlap is too narrow, the panels will tend to gap at the bottom; and if the overlap is too wide, the panels tend to bunch up or wrap around the legs.

Figure 3:
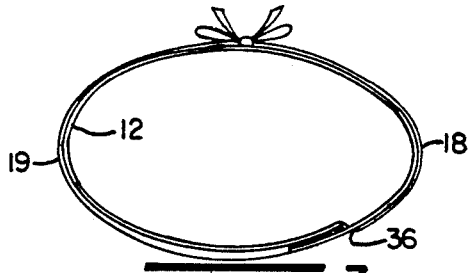
FIG. 3 is a top plan view of the preferred form of dance skirt shown in FIGS. 1 and 2.
Figure 6:
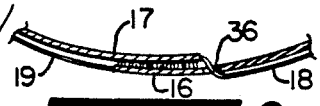
FIG. 6 is an enlarged, fragmentary cross-sectional view of free end portions of the waistband in a preferred form of skirt.
Figure 2:
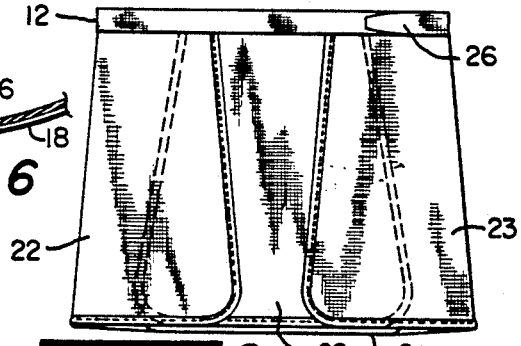
FIG. 2 is a front view in elevation of the dance skirt shown in FIG. 1.

Another important feature of the invention resides in the construction of the waistband 12 of a narrow strip of fabric ribbon and which includes a cover stitch 34 to bind the upper edges 26 of the panels 20 to 23 and increase the overall strength of the band 12. The fasteners 14 and 15 are preferably hook-and-loop fasteners, such as, VELCRO TM, one fastener 14 being in the form of a strip affixed to the external surface of the waistband 12 at the upper edge 26 of the back panel 21, and the second fastener 15 being in the form of a strip which is affixed to the inside of the waistband 12 along the upper edge 26 of the side panel 22. A buttonhole 36 is formed through the thickness of the outer free end of the waistband 12 next to the fastener 15 so that the tie member 18 can be drawn through the buttonhole 36 and together with the tie 19 are passed around the waist and tied together in back, as shown in FIG. 3. In this way, the members 18 and 19 when tied together will lay flat and aid in securing the free ends of the waistband snugly together. Although not shown, a strip of elastic may be stretched and then sewn into the band 12 between the fastener strips 14 and 15 to further aid in assuring a snug fit to the body. The elastic is especially useful in children's skirts, since children typically have less predominant hips to hold up the skirt; and, of course, the utilization of the elastic assures a wider range of adjustment.

The skirt 10 of the present invention is proportioned according to the size of the wearer and, as a dance skirt, is not intended to extend beyond the mid-thigh region. The degree of divergency of the panels 20 to 23 may vary but it is important that there be sufficient overlap to cover the upper legs as described, since the panels are unconnected to one another except at the areas of overlap along their upper edges 26. In a typical skirt construction of an adult, the waistband 12 is formed of a $\frac{7}{8}$" wide, 64" long grosgrain ribbon and tie. In other words, the tie members 18 and 19 merely form extensions of the strip of ribbon making up the waistband itself. The front panel 20 is 8" wide at the waistband and diverges downwardly to a width of 13" across the bottom edge 30; the back panel is 9" wide at the waistband and 13" wide along the bottom edge 30; and the side panels are 10" wide at the waistband and diverge downwardly to 15" wide along their bottom edges 30; also, the side panels overlap the front panel 20 $2\frac{3}{4}$" at the waistband 12 and overlap the back panel $3\frac{1}{4}$ at the waistband 12. The length of the panel, in a vertical direction, is 12" the back panel 31 is 13" in length and the side panels are $12\frac{1}{4}$ in length at the center while being 12" long at the forward edge 28 to correspond to the length of the front panel and are 13" long at their rearward edge 29 to correspond to the length of the back panel 21. Generally, these proportions will be maintained for different adult sizes so that both the width and length of each panel will increase with the length of the waistband, although the degree of overlap between adjacent panels will remain essentially the same. In children's skirts, generally the width and length of each panel is slightly less for a given length of the waistband and that the degree of overlap should be slightly less than in adult sizes. Preferably, each panel is bound along the side edges 28, 29 and the lower edge 30 with a self-binding 38 which is cut on the bias to add weight and body to the edges and to gain greater definition to the movement of the skirt.

It is therefore to be understood that while a preferred form of dance skirt is herein set forth and described, the above and other modifications and changes may be made therein without departing from the spirit and scope of the present invention as defined by the appended claims.

We claim:

1. A dance skirt as an article of wearing apparel comprising:

a waistband; and front, opposite side and back panels extending downwardly from said waistband, each said panel independently connected to said waistband for continuous downward extension therefrom and otherwise unconnected to one another, adjacent of said panels disposed in overlapping relation to one another, and each of said panels having downwardly divergent side edges extending into a lower common edge.

2. A dance skirt according to claim 1, including means for adjusting the size of the waistband, said adjusting means including a pair of flexible tie members at free ends of said waistband.

3. A dance skirt according to claim 2, said waistband having overlapping free ends, and said adjusting means including hook-and-loop fasteners in confronting relation to one another at said free ends.

4. A dance skirt according to claim 3, said adjusting means including flexible, ribbon-like tie members at said free ends, one of said tie members insertable through an opening in an outer one of said free ends to which the other of said tie members is attached.

5. A dance skirt according to claim 1, each of said panels being generally trapezoidal-shaped.

6. A dance skirt according to claim 1, said back panel being longer in a vertical direction than the length of said front panel.

7. A dance skirt according to claim 6, said opposite side panels each having a forward edge of a length substantially corresponding to the length of said front panel and each having a rearward edge of a length a substantially corresponding to the length of said back panel.

8. A dance skirt according to claim 1, said opposite side panels overlapping opposite side edges of said front panel.

9. A dance skirt according to claim 8, said side panels overlapping opposite side edges of said back panel.

10. A dance skirt according to claim 1, said side panels each being wider than said front panel and narrower than said back panel.

11. A dance skirt according to claim 1, said panels each being of a length so as not to extend substantially beyond the mid-thigh region of the dancer.

12. A dance skirt as an article of wearing apparel comprising:

a waistband including means for adjusting the size of said waistband, said adjusting means including a pair of flexible tie members at free ends of said waistband; and front, opposite side and back panels extending downwardly from said waistband, each said panel independently connected to said waistband and unconnected to one another, adjacent of said panels disposed in overlapping relation to one another, said side panels overlapping opposite side edges of said front panel and said back panel.

13. A dance skirt according to claim 12, said waistband having overlapping free ends, and said adjusting means including hook-and-loop fasteners in confronting relation to one another at said free ends.

14. A dance skirt according to claim 13, said adjusting means including flexible, ribbon-like tie members at said free ends, one of said tie members insertable through an opening in an outer one of said free ends to which the other of said tie members is attached.

15. A dance skirt according to claim 12, each of said panels being generally trapezoidal-shaped, said side panels overlapping opposite side edges of said front panel and said back panel.

16. A dance skirt according to claim 12, said back panel being longer in a vertical direction than that of said front panel.

17. A dance skirt according to claim 16, said opposite side panels each being of a length at its forward edge substantially corresponding to the length of said front panel and of a length at its rearward edge substantially corresponding to the length of said back panel.

* * * * *